US010544947B2

(12) United States Patent
Jeong et al.

(10) Patent No.: US 10,544,947 B2
(45) Date of Patent: Jan. 28, 2020

(54) AIR CONDITIONER

(71) Applicant: LG ELECTRONICS INC., Seoul (KR)

(72) Inventors: Changhoon Jeong, Seoul (KR); Yunho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 421 days.

(21) Appl. No.: 15/394,440

(22) Filed: Dec. 29, 2016

(65) Prior Publication Data

US 2017/0191677 A1 Jul. 6, 2017

(30) Foreign Application Priority Data

Dec. 31, 2015 (KR) ..... 10-2015-0191325

(51) Int. Cl.

| | |
|---|---|
| ***F25D 21/14*** | (2006.01) |
| ***F24F 1/0011*** | (2019.01) |
| ***F24F 1/0047*** | (2019.01) |
| ***F24F 13/20*** | (2006.01) |
| ***F24F 13/22*** | (2006.01) |

(52) U.S. Cl.

CPC ..... *F24F 1/0011* (2013.01); *F24F 1/0047* (2019.02); *F24F 13/20* (2013.01); *F24F 13/222* (2013.01); *F24F 2221/26* (2013.01)

(58) Field of Classification Search

CPC .. F24F 11/89; F24F 13/20; F24F 13/22; F24F 2221/14; F24F 2221/16; F24F 2221/17; F24F 13/082; F24F 1/0011; F24F 1/0047; F24F 1/0007; F24F 2013/202; F24F 2013/207; F24F 2013/221; F24F 13/222; F24F 2221/26

See application file for complete search history.

(56) References Cited

U.S. PATENT DOCUMENTS

| | | | | |
|---|---|---|---|---|
| 7,040,543 | B2 * | 5/2006 | Neranjan | G05D 23/1905 236/47 |
| 2002/0152760 | A1 | 10/2002 | Okuda et al. | |
| 2011/0291305 | A1 * | 12/2011 | Choi | F24F 6/00 261/30 |
| 2018/0017282 | A1 * | 1/2018 | Liu | F24F 13/20 |

FOREIGN PATENT DOCUMENTS

| | | | |
|---|---|---|---|
| EP | 1 471 310 | A1 | 10/2004 |
| EP | 1 876 399 | A2 | 1/2008 |
| EP | 2 017 543 | A1 | 1/2009 |
| WO | 2008/136333 | A1 | 11/2008 |

* cited by examiner

*Primary Examiner* — Henry T Crenshaw
*Assistant Examiner* — Kamran Tavakoldavani
(74) *Attorney, Agent, or Firm* — Dentons US LLP

(57) ABSTRACT

An air conditioner that includes a control box accommodating a control board and having an open surface, and a base panel having an air inlet and an air outlet, the control box being mounted on the base panel by seating the open surface thereof on the base panel, wherein the base panel includes a first water-blocking rib surrounding an outer surface of a lower edge defining the open surface of the control box so as to prevent water from flowing into the control box.

20 Claims, 16 Drawing Sheets

AIR CONDITIONER

CROSS-REFERENCE TO RELATED APPLICATION

This application claims the priority benefit of Korean Patent Application No. 10-2015-0191325, filed on Dec. 31, 2015 in the Korean Intellectual Property Office, the disclosure of which is incorporated herein by reference.

BACKGROUND OF THE INVENTION

1. Field of the invention

The present invention relates to an air conditioner, and more particularly to an air conditioner, which is installed on an indoor ceiling.

2. Description of the Related Art

Generally, an air conditioner is an apparatus, which is designed to cool or heat a room interior using a refrigerating cycle including a compressor, an outdoor heat exchanger and an indoor heat exchanger. In other words, an air conditioner may be constituted by a cooling apparatus for cooling a room interior and a heating apparatus for heating the room interior, or may be constituted by a combined apparatus for both cooling and heating.

Among various air conditioners, a ceiling-type air conditioner includes a body that include an indoor unit installed on a ceiling, an indoor heat exchanger disposed in the body and a blower disposed in the body so as to draw indoor air, cause the air to pass through the indoor heat exchanger, and discharge the air to the indoors.

The body is open at the lower face thereof, and an intake and discharge unit including an air inlet and an air outlet is coupled to the open lower portion of the body. The body is embedded in the ceiling so as to be invisible from the room interior whereas the intake and discharge unit is installed outside the ceiling, thereby being visible from the room interior.

The intake and discharge unit includes a vane for opening or closing the air outlet. The vane is coupled at a side area thereof to a rotating shaft of a motor so as to open or close the air outlet using the driving force of the motor. However, since the motor is installed only at the side area of the vane, there is a problem whereby the vane cannot uniformly close the air outlet throughout the entire range from the side area, at which the motor is installed, to the other side area, which is opposite the motor.

The intake and discharge unit includes a control box for controlling or displaying the state of operation of the air conditioner. Accordingly, there is also a problem whereby condensed water, which is generated in the indoor heat exchanger and falls on the intake and discharge unit, flows into the control box and reaches a control board disposed in the control box during the operation of the air conditioner.

In addition, since there is a necessity to check leakage from a refrigerant pipe and breakage of electric wires in the body, it is cumbersome to remove the intake and discharge unit from the body.

SUMMARY OF THE INVENTION

Therefore, the present invention has been made in view of the above problems, and it is an object of the present invention to provide an air conditioner, which is provided with a vane capable of uniformly closing an air outlet.

Another object of the present invention is to provide an air conditioner, which is able to prevent condensed water from flowing into a control box.

A further object of the present invention is to provide an air conditioner, which has an improved appearance and allows easy inspection.

Objects of the present invention are not limited to the above-mentioned objects, and other objects, which are not mentioned herein, will be clearly understood by those skilled in the art from the following description.

In accordance with an aspect of the present invention, the above and other objects can be accomplished by the provision of an air conditioner including a control box accommodating a control board and having an open surface, and a base panel having an air inlet and an air outlet, the control box being mounted on the base panel by seating the open surface thereof on the base panel, wherein the base panel includes a first water-blocking rib surrounding an outer surface of a lower edge defining the open surface of the control box so as to prevent water from flowing into the control box.

In accordance with another aspect of the present invention, the above and other objects can be accomplished by the provision of an air conditioner including a control box accommodating a control board and having an open surface, and a base panel including a first edge part having an air outlet, a second edge part having an air inlet, an isolating plate part disposed between the first edge part and the second edge part so as to isolate the air outlet from the air inlet, a third edge part disposed at one side of the first edge part, a fourth edge part disposed at a remaining side of the first edge part, the control box being mounted on the fourth edge part with the open surface of the control box seated on the fourth edge part, a fifth edge part disposed at one side of the second edge part and the isolating plate part and having at least one inspection opening, and a sixth edge part disposed at a remaining side of the second edge part and the isolating plate part and having at least one inspection opening, wherein the fourth edge part includes a first water-blocking rib surrounding an outer surface of a lower edge defining the open surface of the control box so as to prevent water from flowing into the control box.

Other details of the embodiments are set forth in the detailed description and the accompanying drawings.

The air conditioner according to an embodiment of the present invention offers an effect of improving the design and appearance thereof because the vane uniformly closes the air outlet by means of the bridges.

Furthermore, the air conditioner according to an embodiment of the present invention offers an effect of preventing condensed water from flowing into the control box and of preventing breakage or malfunction of the air conditioner by virtue of the first water-blocking rib and the second water-blocking rib.

In addition, the air conditioner according to an embodiment of the present invention offers an effect of improving the appearance thereof because the dismantling handles, which are provided at the respective inspection opening covers, are invisible from the outside by being covered by the intake grille.

Furthermore, the air conditioner according to an embodiment of the present invention offers an effect of facilitating repair or inspecting work because it is possible to repair or inspect the components or wiring in the body through the inspection openings after removing the inspection opening cover.

The effects obtained by the present invention are not limited to the above-mentioned effects, and other effects, which are not mentioned herein, will be clearly apparent to those skilled in the art from the appended claims.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to embodiments, examples of which are illustrated in the accompanying drawings. However, the present disclosure may be embodied in many different forms and should not be construed as being limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted to avoid obscuring appreciation of the disclosure by a person of ordinary skill in the art. Wherever possible, the same reference numbers will be used throughout the drawings to refer to the same or like parts.

Hereinafter, an air conditioner according to an embodiment of the present invention will be described with reference to the accompanying drawings.

Figure 1:
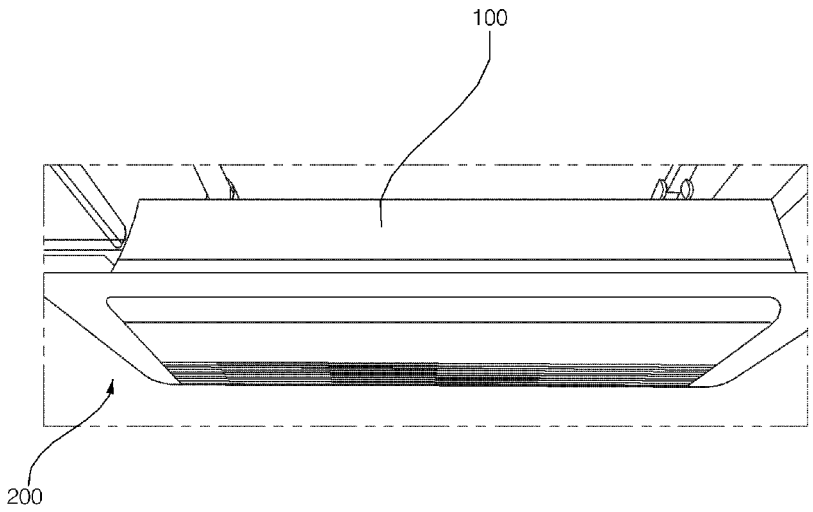
FIG. 1 is a view illustrating an air conditioner according to an embodiment of the present invention.

FIG. 1 is a view illustrating the air conditioner according to the embodiment of the present invention.

Referring to FIG. 1, the air conditioner includes a body 100 and an intake and discharge unit 200. The body 100 is configured to take the form of a hollow rectangular box having an open lower end. The body 100 may be installed in an indoor ceiling, and the intake and discharge unit 200 may be coupled to the open lower end of the body 100 so as to be installed below the ceiling.

The intake and discharge unit 200 may include an air inlet, through which air is drawn into the unit, and an air outlet, through which air is discharged.

The body 100 may be provided therein with a blower, a heat exchanger for exchanging heat with the air, and a filter for filtering contaminants contained in the air drawn through the air inlet.

When the blower is operated, the indoor air may be drawn through the air inlet, and may pass through the filter. The contaminants contained in the air may be captured by the filter. The air, which passes through the filter, may exchange heat with the heat exchanger, and may then be discharged into the room through the air outlet.

Figure 2:
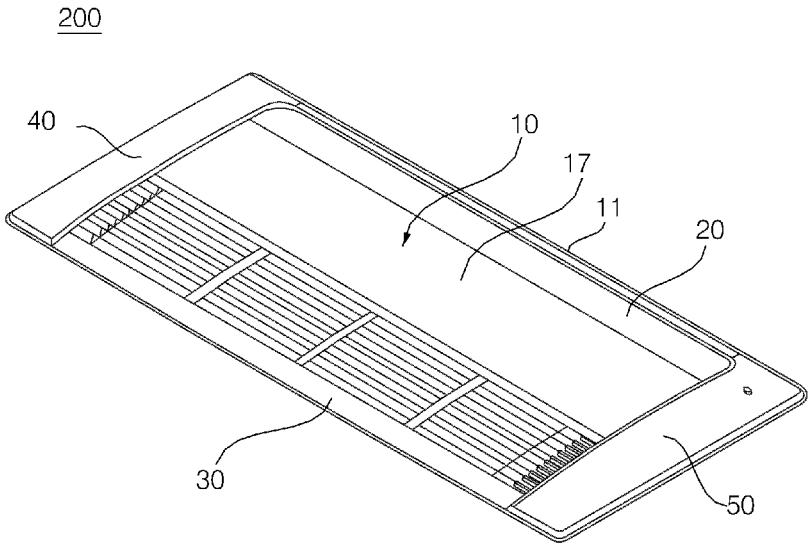
FIG. 2 is a front perspective view illustrating the intake and discharge unit illustrated in FIG. 1.
Figure 3:
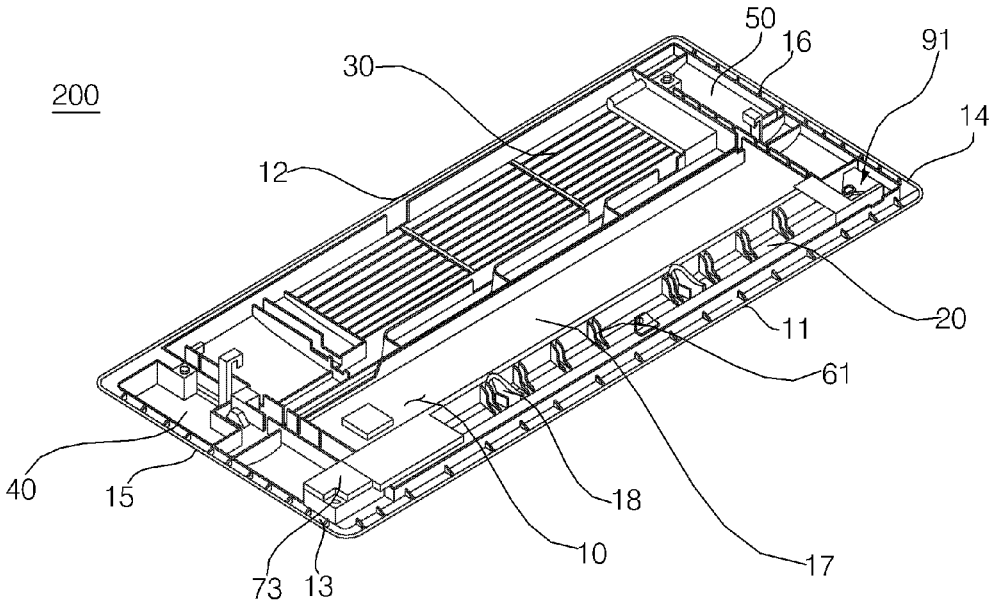
FIG. 3 is a rear perspective view illustrating the intake and discharge unit illustrated in FIG. 1.
Figure 4:
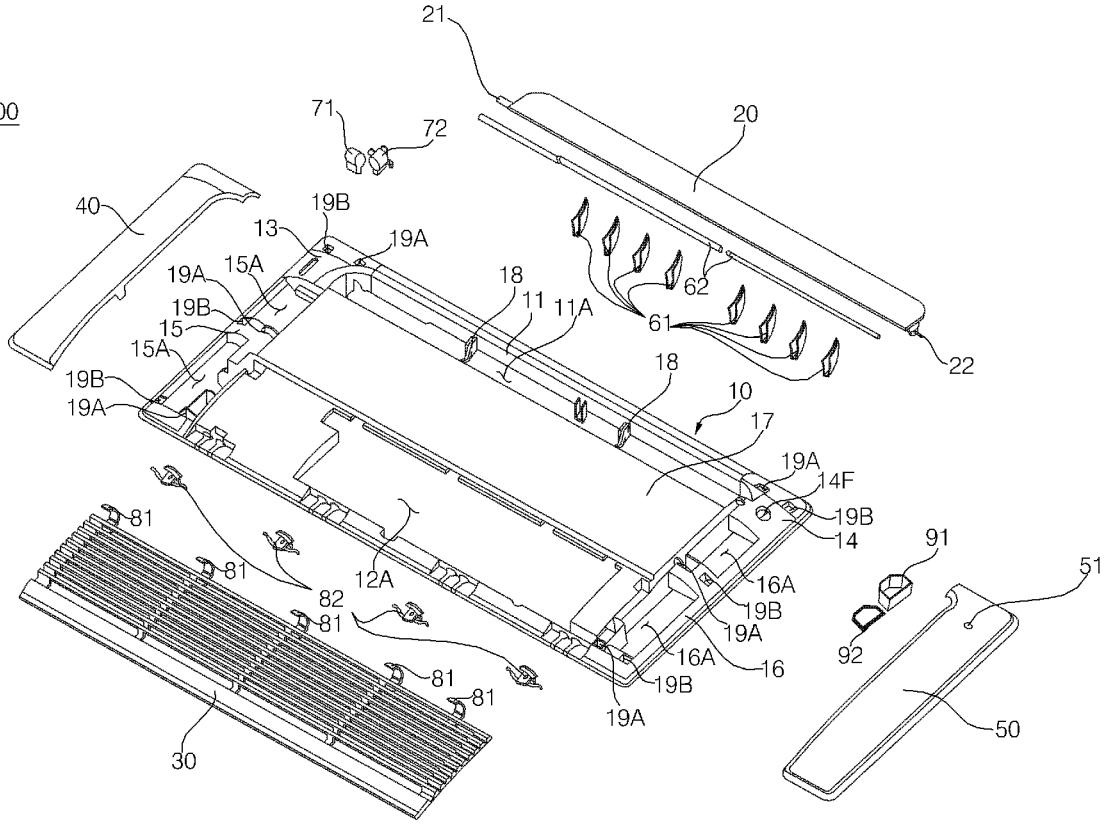
FIG. 4 is an exploded perspective view illustrating the intake and discharge unit illustrated in FIG. 1.

FIG. 2 is a front perspective view illustrating the intake and discharge unit illustrated in FIG. 1. FIG. 3 is a rear perspective view illustrating the intake and discharge unit illustrated in FIG. 1. FIG. 4 is an exploded perspective view illustrating the intake and discharge unit illustrated in FIG. 1.

Referring to FIGS. 2 to 4, the intake and discharge unit 200 includes a base panel 10, a vane 20, an intake grille 30, a first inspection opening cover 40 and a second inspection opening cover 50. When the intake and discharge unit 200 is installed at the ceiling, the vane 20, the intake grille 30, the first inspection opening cover 40 and the second inspection opening cover 50 are disposed on the lower surface of the base panel 10. Hereinafter, the terms "upper" and "lower", which are used herein to describe directions, should be considered to indicate "upper" and "lower" in the state in which the intake and discharge unit 200 is installed at the ceiling.

The base panel 10 is configured to have a rectangular shape. The base panel 10 includes an isolating plate part 17, and edge parts 11, 12, 13, 14, 15 and 16, which surround the isolating plate part 17 so as to define the marginal portion of the intake and discharge unit 200.

The isolating plate part 17 is configured to have a rectangular shape, and protrudes further downward than the edge parts 11, 12, 13, 14, 15 and 16. The lower surface (outside surface) of the isolating plate part 17 has a flat surface. The isolating plate part 17 is disposed at a position that is deviated forward from the center of the base panel 10.

The edge parts 11, 12, 13, 14, 15 and 16 include a first edge part 11, which is disposed ahead of the isolating plate part 17, a second edge part 12, which is disposed behind the isolating plate part 17, a third edge part 13, which is disposed to the left of the first edge part 11, a fourth edge part 14, which is disposed to the right of the first edge part 11, a fifth edge part 15, which is disposed to the left of the isolating plate part 17 and the second edge part 12, and a sixth edge part 16, which is disposed on the right of the isolating plate part 17 and the second edge part 12. The fifth edge part 15 is disposed behind the third edge part 13, and the sixth edge part 16 is disposed behind the fourth edge part 14.

Each of the edge parts 11, 12, 13, 14, 15 and 16 is inclined upward moving toward the edge thereof. Specifically, the first edge part 11 is inclined upward moving forward. The second edge part 12 is inclined upward moving rearward. Assuming that the third edge part 13 is divided into two segments by the diagonal line that extends through the front left corner of the isolating plate part 17 and the front left corner of the third edge part 13, the segment of the third edge part 13 that is located closer to the first edge part 11 is inclined upward moving forward, and the segment of the third edge part 13 that is located closer to the fifth edge part 15 is inclined upward moving leftward. Furthermore, assuming that the fourth edge part is divided into two segments by a diagonal line that extends through the front right corner of the isolating plate part 17 and the front right corner of the fourth edge part 14, the segment of fourth edge part 14 that is located closer to the first edge part 11 is inclined upward moving forward, and the segment of the fourth edge part 14 that is located closer to the sixth edge part 16 is inclined upward moving rightward. In addition, assuming that the fifth edge part 15 is divided into two segments by the diagonal line that extends through the rear left corner of the isolating plate part 17 and the rear left corner of the fifth edge part 15, the segment of the fifth edge part 15 that is located closer to the third edge part 13 is inclined upward moving leftward, and the segment of the fifth edge part 15 that is located closer to the second edge part 12 is inclined upward moving rearward. Furthermore, assuming that the sixth edge part 16 is divided into two segments by the diagonal line that extends through the rear right corner of the isolating plate part 17 and the rear right corner of the sixth edge part 16, the segment of sixth edge part 16 that is located closer to the fourth edge part 14 is inclined upward moving rightward, and the segment of the sixth edge part 16 that is located closer to the second edge part 12 is inclined upward moving rearward.

The first edge part 11 constitutes the front section of the base panel 10, and the second edge part 12 constitutes the rear section of the base panel 10. The first edge part 11 and the second edge part 12 have the same length in the lateral direction as that of the isolating plate part 17. The first edge part 11 has a shorter length in the anteroposterior direction than the second edge part 12, and the second edge part 12 has a longer length in the anteroposterior direction than the first edge part 11. The first edge part 11 is provided with an air outlet 11A through which air is discharged, and the second edge part 12 is provided with an air inlet 12A through which air is drawn. The air outlet 11A and the air inlet 12A are isolated from each other by the isolating plate part 17. The air outlet 11A has the same length in the lateral direction as the isolating plate part 17, and the air inlet 12A has a shorter length in the lateral direction than the isolating plate part 17.

The first edge part 11 is provided with a vane 20 for opening or closing the air outlet 11A, a plurality of louvers 61 for directing the air discharged through the air outlet 11A to the right or left, and at least one link 62, which connects the louvers 61 to each other and rotates the louvers 61 collectively to the right or left so as to control the louvers 61 to guide air to the right or left.

The vane 20 is elongated in the lateral direction so as to have sufficient surface area to block the air outlet 11A. The vane 20 is preferably configured to have an inclination corresponding to that of the first edge part 11. The vane 20 has a rotating shaft, which is horizontally positioned in the lateral direction, and rotates upward and downward so as to close and open the air outlet 11A. The vane 20 may be rotated upward and downward by driving force from a vane-rotating motor 71. The rear end of the vane 20 may be raised upward beyond the base panel 10 through the air outlet 11A when the air outlet 11A is opened, and may emerge downward from the base panel 10 through the air outlet 11A when the air outlet 11A is closed.

The louvers 61 may be configured such that the rotating shafts thereof are vertically positioned so as to control the direction in which air is discharged through the air outlet 11A to the right and left by being rotated to the right and left. The louvers 61 are preferably disposed above the air outlet 11A.

The link 62 may be elongated in the lateral direction, and may rotate the louvers 61 to the right and left while being moved to the right and left. The link 62 may be moved to the right and left by the driving force from a louver-rotating motor 72.

The vane-rotating motor 71 and the louver-rotating motor 72 may be hidden by a motor cover 73, which is disposed above the third edge part 13.

The second edge part 12 is provided on the lower surface thereof with an intake grille 30 for partially covering the air inlet 12A. The intake grille 30 is mounted on the base panel 10, which corresponds to the air inlet 12A. The intake grille 30 is preferably configured to have an inclination corresponding to that of the second edge part 12. The intake grille 30 may be mounted on or removed from the base panel 10 in such a manner that the rear end thereof is rotated upward and downward about the front end thereof, which serves as the rotating axis. The front end of the intake grille 30 is coupled to the rear end of the isolating plate part 17 by a plurality of clips 81, and the rear end of the intake grille 30 is coupled to the rear end of the second edge part 12 by a plurality of grille locks 82.

The third edge part 13 constitutes the front left corner section of the base panel 10, and the fourth edge part 14 constitutes the front right corner section of the base panel 10. The third edge part 13 is provided on the upper surface thereof with the vane-rotating motor 71 and the louver-rotating motor 71, and the fourth edge part 14 is provided on the upper surface thereof with a control box 91. The control box 91 accommodates a control board 92 therein.

The fifth edge part 15 constitutes a portion of the left section and the rear left corner section of the base panel 10, and the sixth edge part 16 constitutes a portion of the right section and the rear right corner section of the base panel 10. The fifth edge part 15 is provided with at least one inspection opening 15A, and the sixth edge part is also provided with at least one inspection opening 16A.

The third edge part 13 and the fifth edge part 15 are provided on the lower surfaces thereof with the first inspection opening cover 40, and the fourth edge part 14 and the sixth edge part 16 are provided on the lower surfaces thereof with the second inspection opening cover 50. The first inspection opening cover 40 covers the lower surfaces of the third edge part 13 and the fifth edge part 15, and the second inspection opening cover 50 covers the lower surfaces of the fourth edge part 14 and the sixth edge part 16. The first inspection opening cover 40 is preferably configured to have an inclination corresponding to that of the third edge part 13 and the fifth edge part 15, and the second inspection opening cover 50 is preferably configured to have an inclination corresponding to that of the fourth edge part 14 and the sixth edge part 16. When there is a need to inspect the air conditioner due to failure thereof, it is possible to inspect or repair the components and the wiring in the body 100 through at least one of the inspection opening covers 15A and 16A after at least one of the first inspection opening cover 40 and the second inspection opening cover 50 is removed from the base panel 10.

Figure 5:
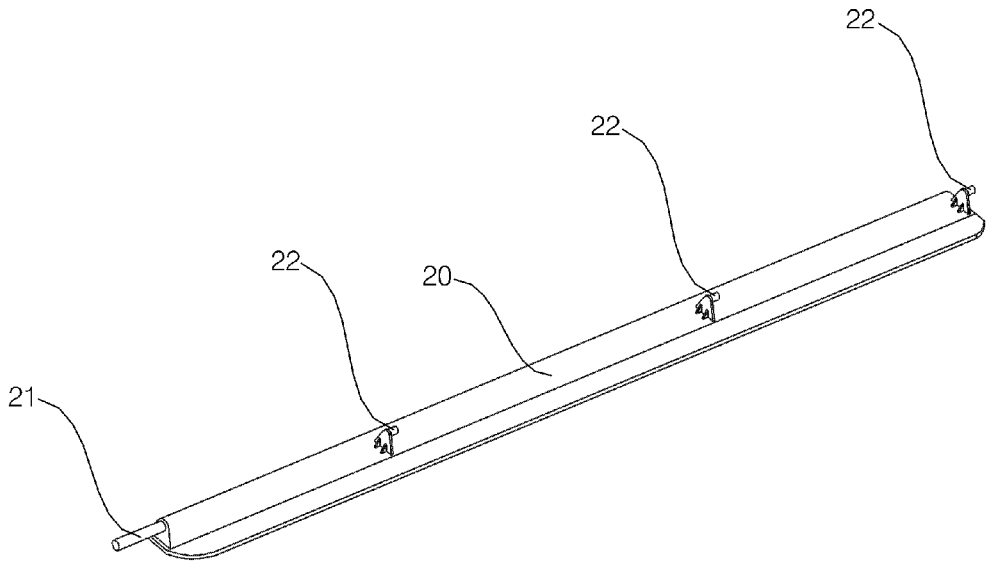
FIG. 5 is a rear perspective view of a vane.
Figure 6:
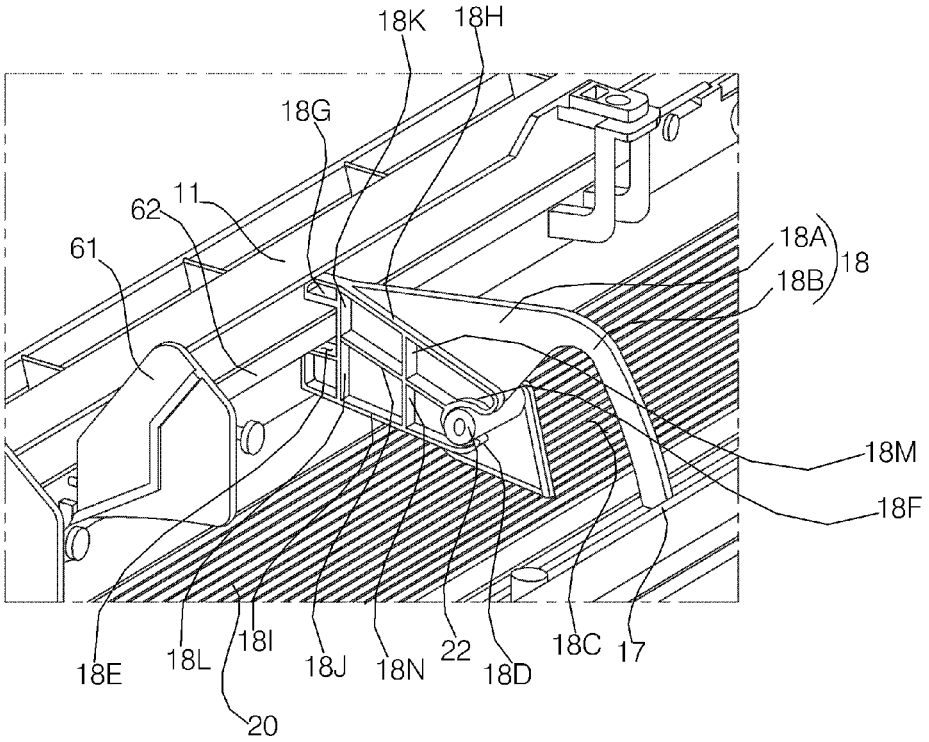
FIG. 6 is a view illustrating the vane coupled to a bridge, in which the vane closes an air outlet.
Figure 7:
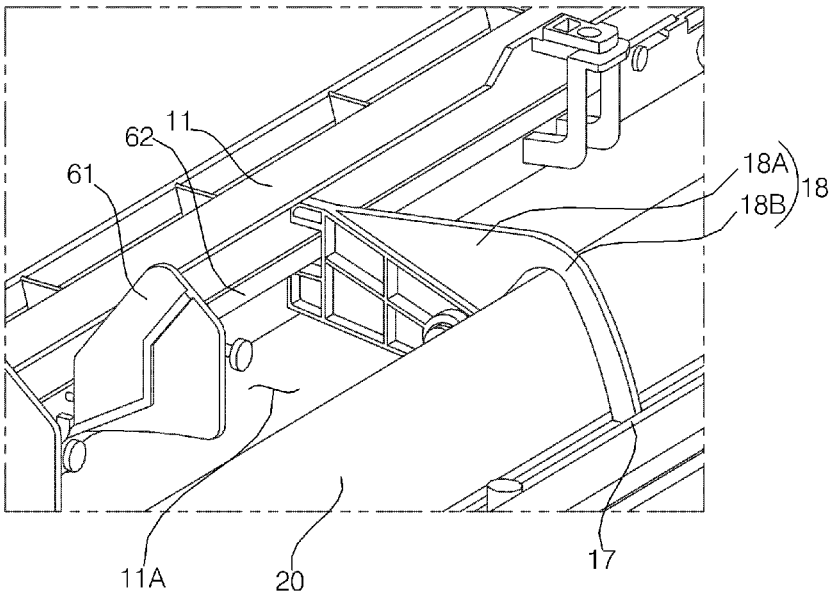
FIG. 7 is a view illustrating the vane, which opens the air outlet.

FIG. 5 is a rear perspective view of the vane. FIG. 6 is a view illustrating the vane coupled to a bridge, in which the vane closes the air outlet. FIG. 7 is a view illustrating the vane, which opens the air outlet.

Referring to FIGS. 4 to 7, the vane 20 is provided with rotating shafts 21 and 22. The rotating shafts 21 and include a main rotating shaft 21, which is projected leftward and coupled to the vane-rotating motor 71, and a plurality of sub rotating shafts 22, which are formed on the rear surface of the vane 20. The sub rotating shafts 22 may be spaced apart from each other in the longitudinal direction of the vane 20. When the vane 20 is rotated by the main rotating shaft 21, which is rotated by the driving force of the vane-rotating motor 71, the sub rotating shafts uniformly disperse the rotational force of the main rotating shaft 21, thereby enabling the vane 20 to be uniformly rotated along it entire length.

The base panel 10 is provided on the rear surface thereof with a plurality of bridges 18, to which the sub rotating shafts 22 of the vane 20 are rotatably coupled. The bridges 18 rotatably support the sub rotating shafts 22 such that the vane 20 is rotated about the rotating shafts 22, which serve as the rotating axis so as to open and close the air outlet 11A.

Each of the bridges 18 extends across the air outlet 11A in the anteroposterior direction, and is integrally formed at opposite ends thereof with the base panel 10. In other words, one end of the bridge 18 is integrally formed with the first edge part 11, and the other end of the bridge 18 is integrally formed with the isolating plate part 17.

Since the vane-rotating motor 71 is mounted only to the left of the vane 20, there is the possibility that the vane 20 does not uniformly close the air outlet 11A throughout the entire range from the left end to the right end of the air outlet 11A. However, since the bridge 18 is supported at opposite ends thereof by the base panel 10, the bridge 18 brings the vane 20 into close contact with the base panel 10, thereby enabling the vane 20 to uniformly close the air outlet 11A throughout the entire range from the left end to the right end of the air outlet 11A.

The bridge 18 is constituted by a plate body. The bridge 18 includes a body portion 18A and a hook portion 18B. The body portion 18A has a larger surface area than the hook portion 18B, and the hook portion 18B extends from the rear upper portion of the body portion 18A while being curved downward so as to have a predetermined radius of curvature. Consequently, a vane-accommodating groove 18C, which is open downward, is defined between the body portion 18A and the hook portion 18B. When the front end of the vane 20 is lowered while the vane 20 is rotated about the sub rotating shafts 22, which serve as the rotating axis, so as to open the air outlet 11A, the rear end of the vane 20 is inserted into the vane-accommodating groove 18C. In other words, the vane-accommodating groove provides a space in which the vane 20 is rotated.

The bridge 18 has a hinge groove 18D, which is located inside and in front of the vane-accommodating groove 18C and to which the sub rotating shaft 22 of the vane 20 is coupled. The hinge groove 18D is formed in the rear end of the body portion 18A and communicates with the vane-accommodating groove 18C. The body portion 18A is provided at the front end thereof with a through groove 18E, through which the link 62 extends. The link 62 may be moved to the right and left in the through groove 18E by driving force from the louver-rotating motor 72.

However, since the bridge 18 has a lot of grooves, that is, the vane-accommodating groove 18C, the hinge groove 18D and the through groove 18E, the rigidity of the bridge is decreased, and there is thus the concern about breakage of the bridge 18 when the vane 20 is rotated. In order to increase the rigidity of the bridge 18, the body portion 18A of the bridge 18 is provided with a plurality of protruding ribs 18F, 18G, 18H, 18I and 18J. The plurality of ribs 18F, 18G, 18H, 18I and 18J may be formed only at the left side surface of the body portion 18A or only at the right side surface of the body portion 18A. Alternatively, the plurality of ribs 18F, 18G, 18H, 18I and 18J may be formed at both side surfaces of the body portion 18A.

In this embodiment, the plurality of ribs 18F, 18G, 18H, 18I and 18J will be described as being formed only at the left side surface of the body portion 18A.

The plurality of ribs 18F, 18G, 18H, 18I and 18J include a hinge groove rib 18F, which is formed at the left side of the hinge groove 18D so as to have a shape corresponding to the hinge groove 18D, a through groove rib 18G, which is formed at the left side of the through groove 18E so as to have a shape corresponding to the through groove 18E, and one or more connecting ribs 18H, 18I and 18J, which connect the hinge groove rib 18F to the through groove rib 18G.

The one or more connecting ribs 18H, 18I and 18J include a first connecting rib 18H, connecting the upper end of the hinge groove rib 18F to the upper end of the through groove rib 18G, a second connecting rib 18I, connecting the lower end of the hinge groove rib 18F to the lower end of the through groove rib 18G, and a third connecting rib 18J, connecting an intermediate portion between the two ends of the hinge groove rib 18F to an intermediate portion between the two ends of the through groove rib 18G.

At least a portion of each of the first and second connecting ribs 18H and 18I extends through a side edge of the body portion 18A. Specifically, the first connecting rib 18H extends obliquely from the upper end of the hinge groove rib 18F to the upper end of a side edge of the body portion 18A, and then extends from the upper end of the side edge of the body portion 18A to the upper end of the through groove rib 18G so as to be formed at the upper end of the front edge of the body portion 18A and at a portion of the front edge of the body portion 18A. The second connecting rib 18I extends from the lower end of the hinge groove rib 18F to the lower end of the through groove rib 18G, and then extends from the lower end of the through groove rib 18F to the lower end of the through groove rib 18G so as to be formed along the lower end of the front edge the body portion 18A and along a portion of the front edge of the body portion 18A.

The body portion 18A of the bridge 18 may be further provided with a fourth connecting rib 18K, a fifth connecting rib 18L, a sixth connecting rib 18M and a seventh connecting rib 18N. The fourth connecting rib 18K vertically extends so as to connect the through groove rib 18G to the first connecting rib 18H. The fifth connecting rib 18L vertically extends so as to connect the through groove rib 18G to the second connecting rib 18I. The sixth connecting rib 18M vertically extends so as to connect the first connecting rib 18H to the third connecting rib 18J. The seventh rib 18N vertically extends so as to connect the second connecting rib 18I to the third connecting rib 18J.

Figure 8:
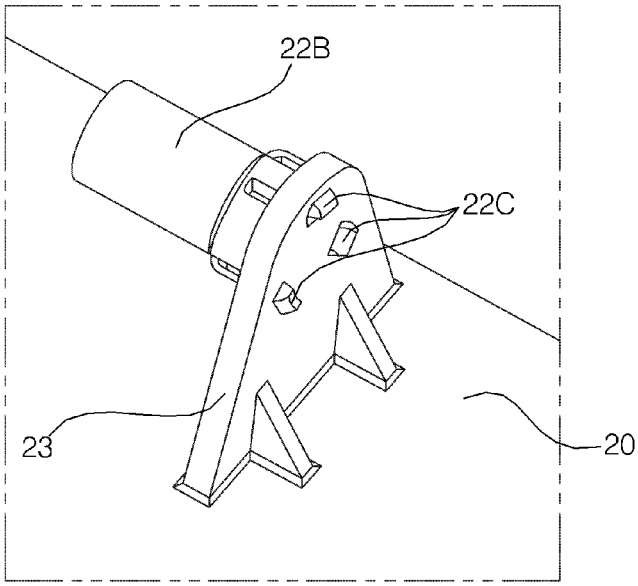
FIG. 8 is a view illustrating the rotating shaft of the vane illustrated in FIG. 5.
Figure 9:
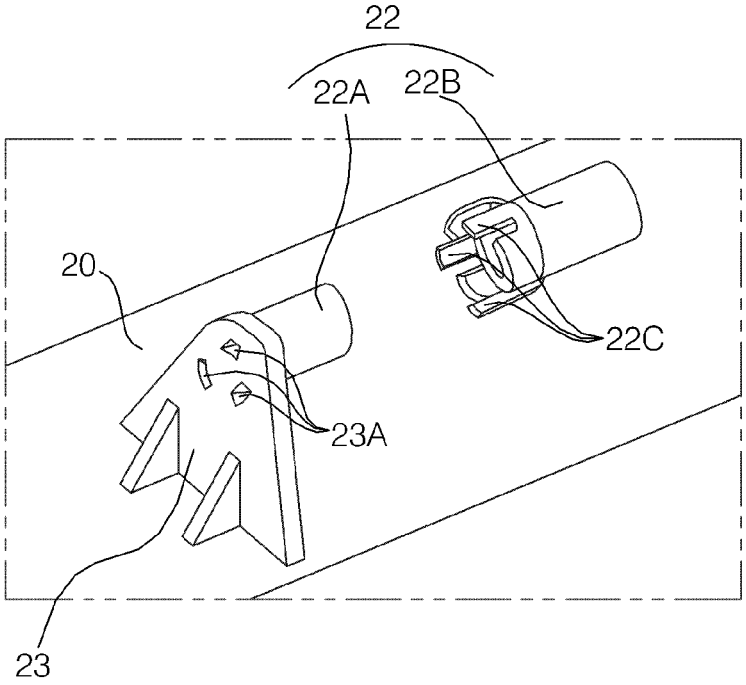
FIG. 9 is an exploded perspective view of FIG. 8.

FIG. 8 is a view illustrating the rotating shaft of the vane illustrated in FIG. 5. FIG. 9 is an exploded perspective view of FIG. 8.

Referring to FIGS. 8 and 9, the rotating shaft 22 of the vane 20 includes a base shaft 22A and a base shaft cover 22B surrounding the base shaft 22A. The base shaft cover 22B is made of a different material from the base shaft 22A so as to reduce friction between the base shaft cover 22B and the bridge 18 and to thus prevent the generation of noise while the vane 20 is rotated.

The vane 20 is provided with a cover coupler 23, which is projected upward, and the base shaft 22A is projected from the right side surface of the cover coupler 23. The cover coupler 23 is provided therein with hook holes 23A, and the base shaft cover 22B is provided with hook protrusions 22C, which are fitted into the hook holes 23A and coupled thereto. In other words, since the base shaft cover 22B is coupled to the cover coupler 23 in a hook-engagement manner, the coupling thereof to the cover coupler 23 is facilitated. The hook holes 23A are spaced apart from each other in the circumferential direction of the base shaft 22A, and the hook protrusions 22C are formed at positions corresponding to those of the hook holes 23A.

Figure 10:
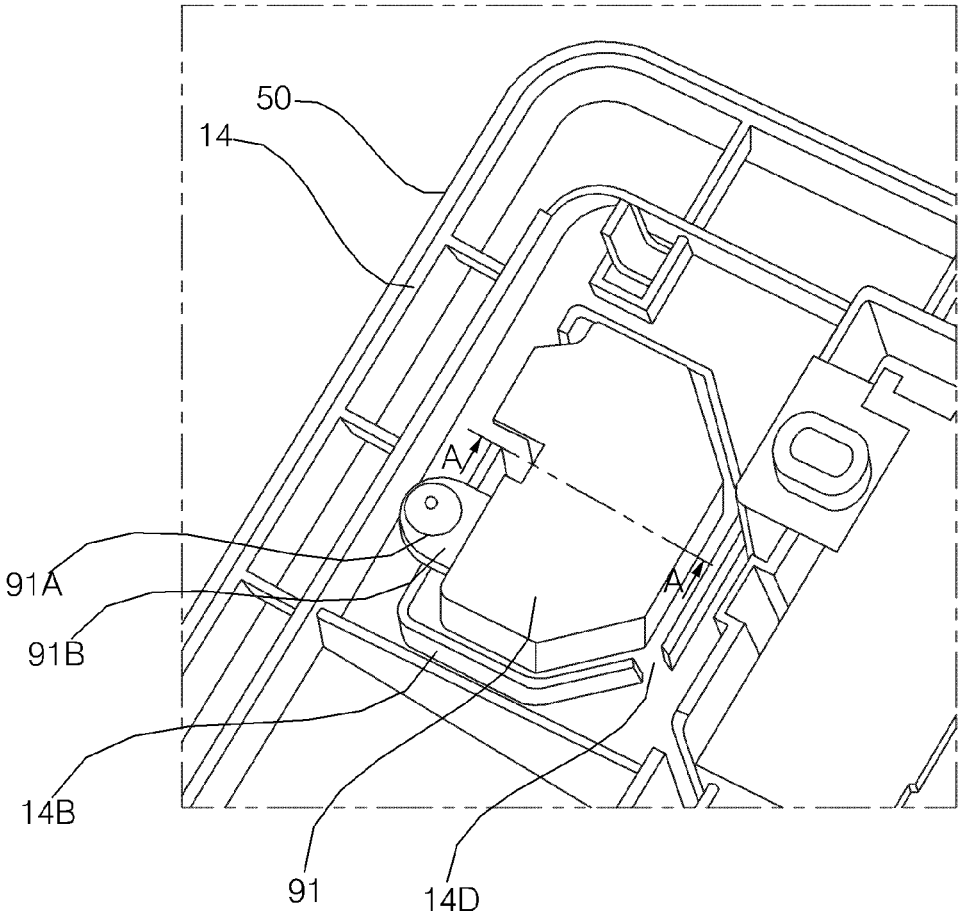
FIG. 10 is a view illustrating a fourth edge part illustrated in FIG. 3.
Figure 11:
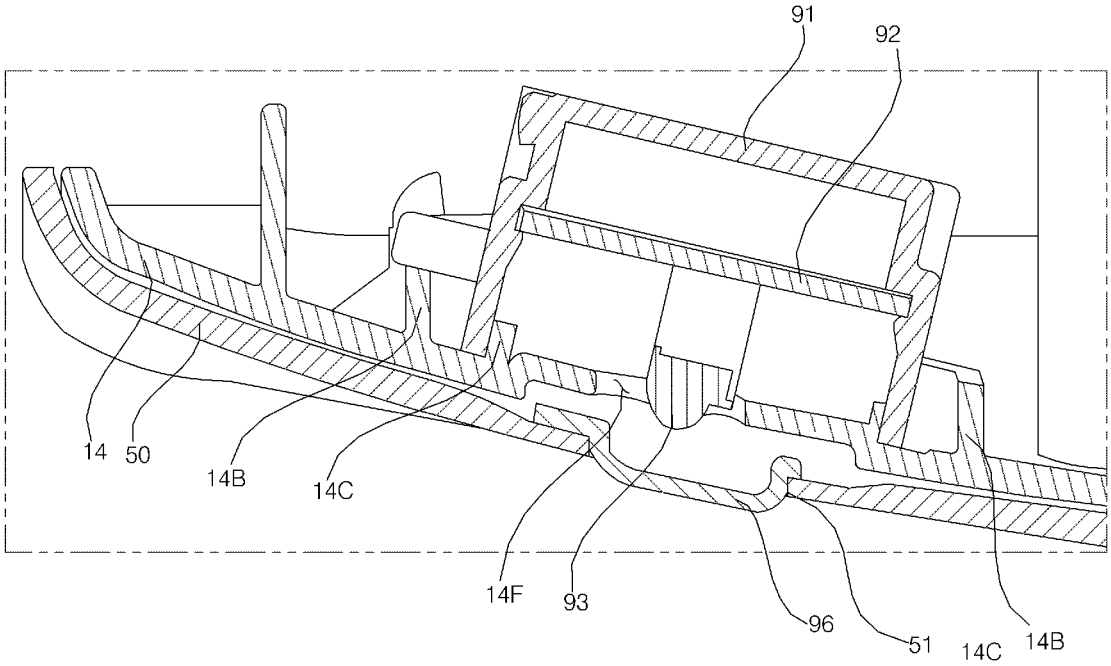
FIG. 11 is a cross-sectional view taken along line A-A in FIG. 10.
Figure 12:
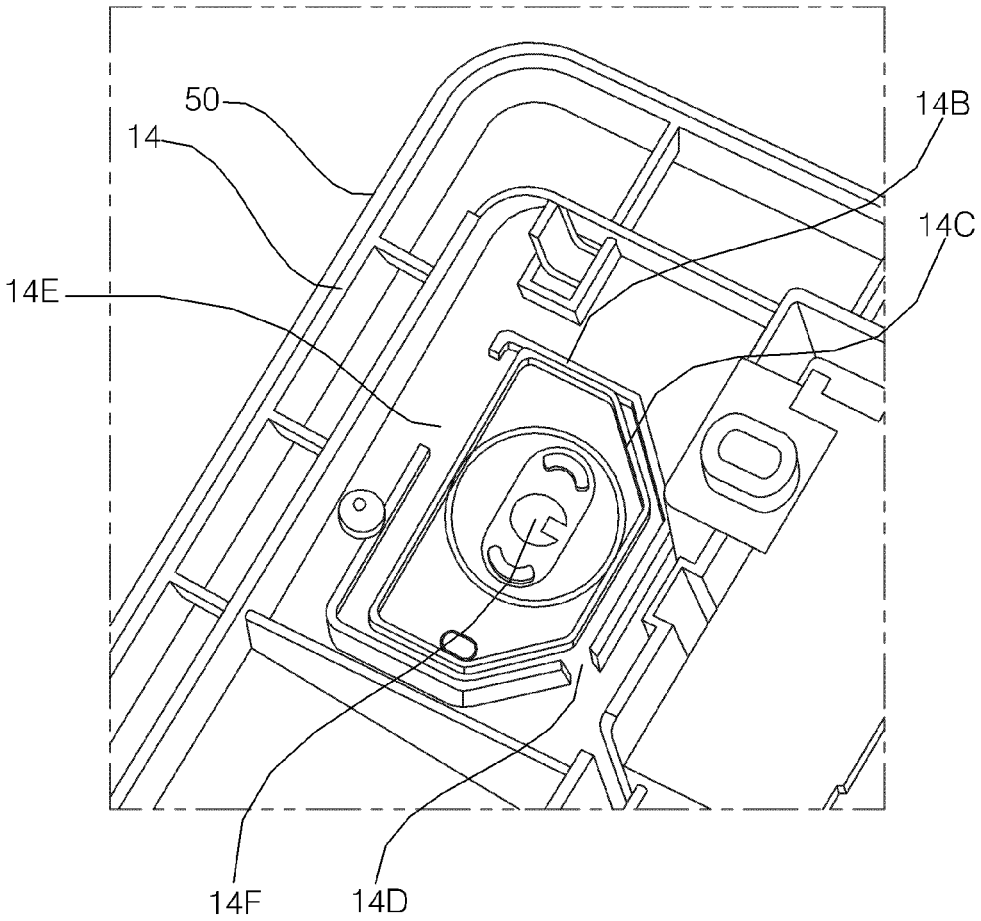
FIG. 12 is a view illustrating the fourth edge part illustrated in FIG. 10, from which a control box is removed.
Figure 13:
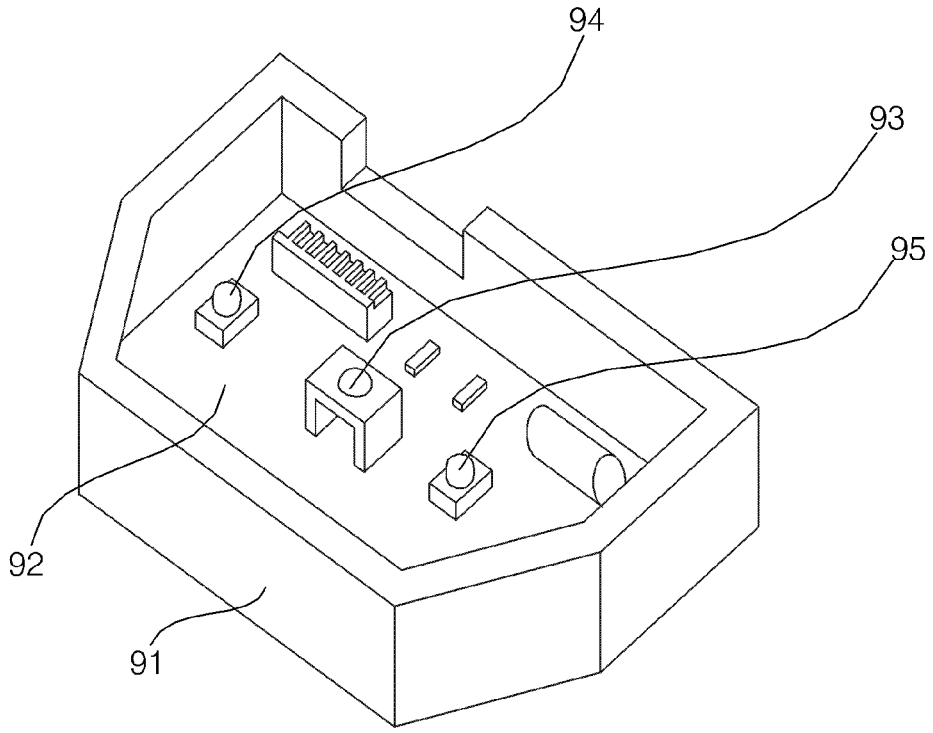
FIG. 13 is a view illustrating the opposite surface of the control box illustrated in FIG. 10.

FIG. 10 is a view illustrating the fourth edge part illustrated in FIG. 3. FIG. 11 is a cross-sectional view taken along line A-A in FIG. 10. FIG. 12 is a view illustrating the fourth edge part illustrated in FIG. 10, from which the control box is removed. FIG. 13 is a view illustrating the opposite surface of the control box illustrated in FIG. 10.

Referring to FIGS. 10 to 13, the control box 91 is mounted on the upper surface of the fourth edge part 14 of the base panel 10. The control box 91 is able to control and display the operation of the air conditioner. The control box 91 is coupled to the fourth edge part 14, with the lower surface thereof mounted on the fourth edge part 14. The control box 91 is provided on the outer surface thereof with a fastening piece 91B, which protrudes therefrom and has a fastening hole 91A, and the fourth edge part 14 is provided on the upper surface thereof with a fastening protrusion 14A, which is fitted into the fastening hole 91A so as to couple the control box 91 to the fourth edge part 14.

The control box 91 defines therein a hollow space in which the control board 92 is accommodated. The control board 92 is preferably made of a printed circuit board (PCB).

The control board 92 is provided with a receiver 93 and with light sources 94 and 95, which are disposed on both lateral sides of the receiver 93 so as to create light in response to input of a specific control signal. The receiver 93 may receive a control signal from a remote controller, which is manipulated by a user. The light sources 94 and 95 may be embodied as light-emitting diodes (LEDs). The light sources 94 and 95 may create light having different colors, and a user may check the operational state of the air conditioner by observing the colors, created by the light sources 94 and 95, with his/her eyes.

In order for the receiver 93 to receive a control signal from the remote controller and for a user to observe the light created by the light sources 94 and 95 with his/her eyes, the control box 91 is open at the lower surface thereof that is seated on the fourth edge part 14. Hence, when water condensed on the indoor heat exchanger in the body 100 falls on the fourth edge part 14 in the state in which the control box 91 is mounted on the fourth edge part 14, there is the concern about malfunction or breakage of the air conditioner because the condensed water flows into the control box 91 and infiltrates the control board 92.

In order to prevent the condensed water from flowing into the control box 91, the fourth edge part 14 is provided on the upper surface thereof with a first water-blocking rib 14*b*, which surrounds the outer surface of the lower edge of the control box 91, and a second water-blocking rib 14C, which surrounds the inner surface of the lower edge of the control box 91. When the control box 91 is mounted on the fourth edge part 14, the lower edge of the control box 91 is disposed between the first water-blocking rib 14B and the second water-blocking rib 14C.

The first water-blocking rib 14B serves to primarily prevent condensed water, having fallen on the fourth edge part 14, from flowing into the control box 91. Even when the condensed water runs over the first water-blocking rib 14B and flows between the first water-blocking rib 14B and the second water-blocking rib 14C, the second water-blocking rib 14C serves to secondarily prevent the condensed water from flowing into the control box 91.

The first water-blocking rib 14B and the second water-blocking rib 14C are configured to have shapes corresponding to the lower edge of the control box 91.

The first water-blocking rib 14B may be open at a portion thereof so as to define a water discharge opening 14D. Consequently, condensed water, which runs over the first water-blocking rib 14B and flows between the first water-blocking rib 14B and the second water-blocking rib 14C, is discharged to the outside of the first water-blocking rib 14B through the water discharge opening 14D. The water discharge opening 14D is preferably formed at the lowest area of the fourth edge part 14. Accordingly, the water discharge opening 14D is formed at an area of the fourth edge part 14 that is close to the isolating plate part 17.

Furthermore, the first water-blocking rib 14B is open so as to define a wiring opening 14E, through which electric wires connected to the control board 92 extend outward. In order to prevent condensed water from flowing into the control box 91 along the electric wires connected to the control board 92 when condensed water runs over the first water-blocking rib 14B and flows between the first water-blocking rib 14B and the second water-blocking rib 14C, the wiring opening 14E is preferably formed at the highest area of the fourth edge part 14. Accordingly, the wiring opening 14E is formed at an area of the fourth edge part 14 that is far away from the isolating plate part 17.

The fourth edge part 14 is provided with a receiver hole 14F in which the receiver 93 is disposed. The receiver hole 14F is formed at the area of the fourth edge part 14 that is defined by the second water-blocking rib 14C. The receiver hole 14F is configured to have a size that is slightly greater than the size that allows the receiver 93 to be tightly fitted into the receiver hole 14F, so that a circuit printed on the control board 92 is prevented, as far as possible, from being visible through the receiver hole 14F while allowing light emitted from the light sources 94 and 95 to pass through the receiver hole 14F.

The fourth edge part 14 is provided under the lower surface thereof with a receiver window 96, which covers the receiver hole 14F. The receiver window 96 covers the receiver hole 14F so as to protect the receiver 93 from the outside. The receiver window 96 is preferably made of a material having an appropriate color, which allows control signals from the remote controller and light emitted from the light sources 94 and 95 to be transmitted therethrough. The fourth edge part 14 and the sixth edge part 16 are provided under the lower surfaces thereof with the second inspection opening cover 50. The receiver window 96 is disposed between the fourth edge part 14 and the second inspection opening cover 50.

The second inspection opening cover 50 is provided with a window hole 51, through which the receiver window 96 is exposed. The receiver window 96 may be partially fitted into and disposed in the window hole 51. Specifically, the receiver window 96 is provided with a convex portion, which is convex downward so as to be fitted into the window hole 51. The window hole 51 is preferably configured to have a size that allows light emitted from the light sources 94 and 95 to be transmitted therethrough, similar to the receiver hole 14F.

Referring to FIG. 4, the first inspection opening cover 40 is coupled to the third edge part 13 and the fifth edge part 15, and the second inspection opening cover 50 is coupled to the fourth edge part 14 and the sixth edge part 16. The third edge part 13 and the fifth edge part 15 are provided with hook holes 19A and 19B for coupling of the first inspection opening cover 40, and the fourth edge part 14 and the sixth edge part 16 are provided with hook holes 19A and 19B for coupling of the second inspection opening cover 50. In other words, the first inspection opening cover 40 is coupled to the third edge part 13 and the fifth edge part 15 in a hook-engagement manner, and the second inspection opening cover 50 is coupled to the fourth edge part 14 and the sixth edge part 16 in a hook-engagement manner.

Figure 14:
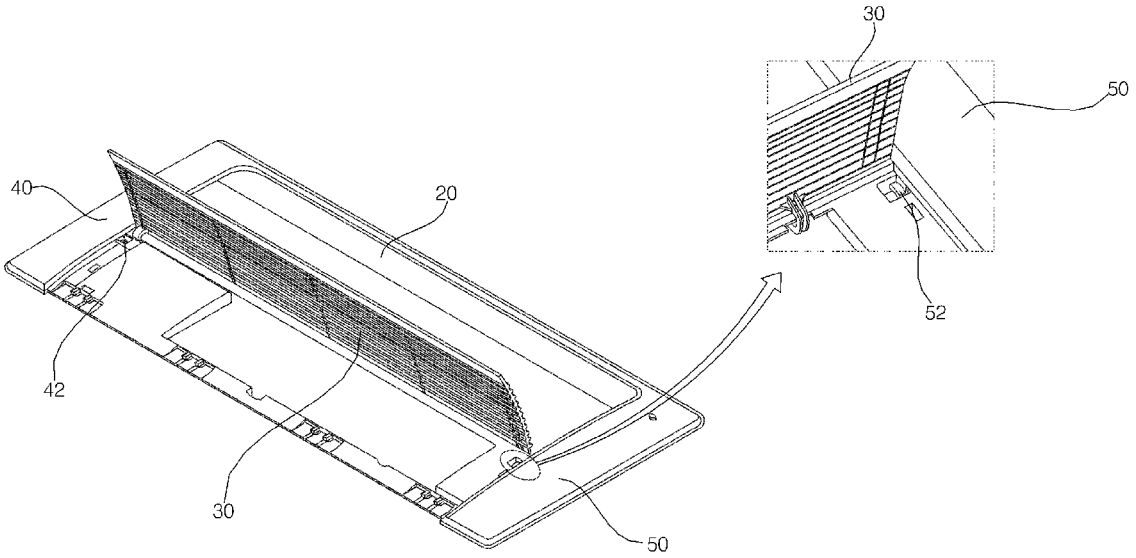
FIG. 14 is a view illustrating an intake grille illustrated in FIG. 2, which is open.
Figure 15:
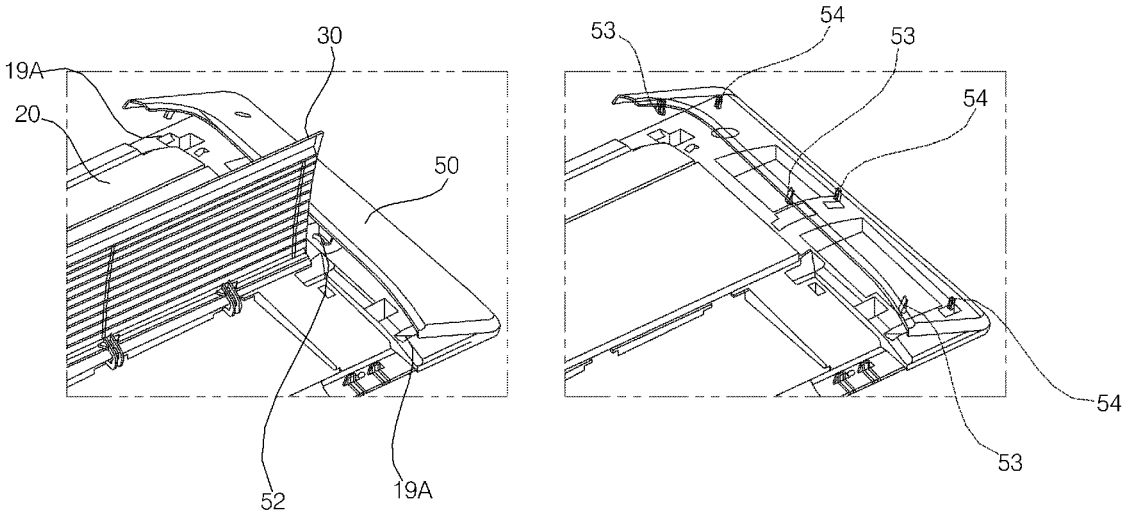
FIG. 15 is a perspective view illustrating the initial stage of an operation of removing an inspection opening cover from a base panel.
Figure 16:
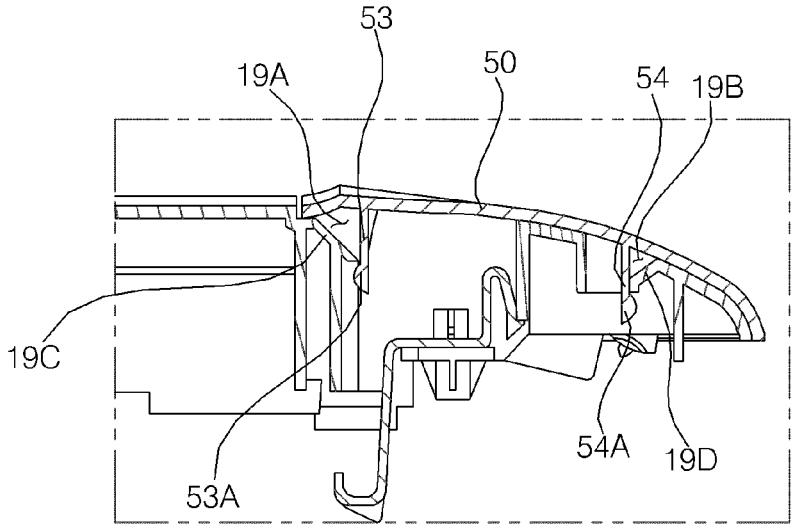
FIG. 16 is a cross-sectional view illustrating the inspection opening cover, which is coupled to the base panel.
Figure 17:
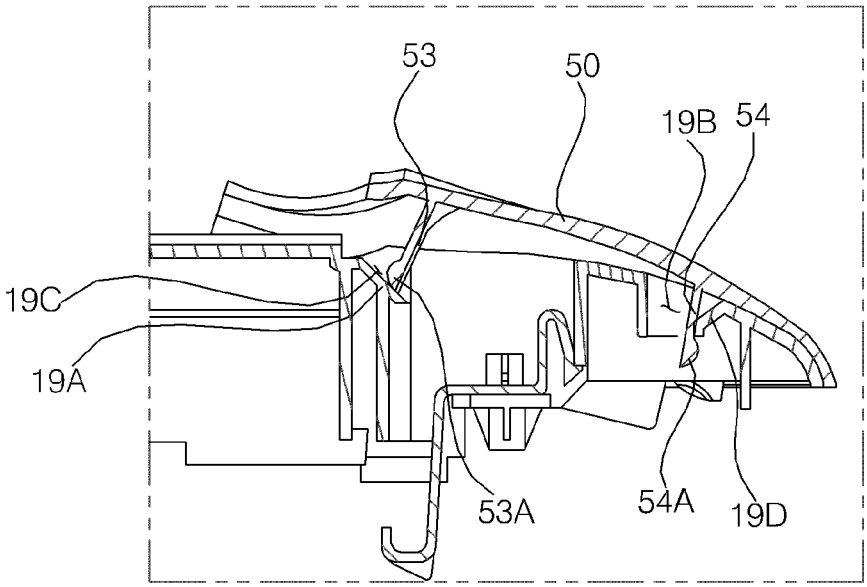
FIG. 17 is a cross-sectional view illustrating the initial stage of the operation of removing the inspection opening cover from the base panel.
Figure 18:
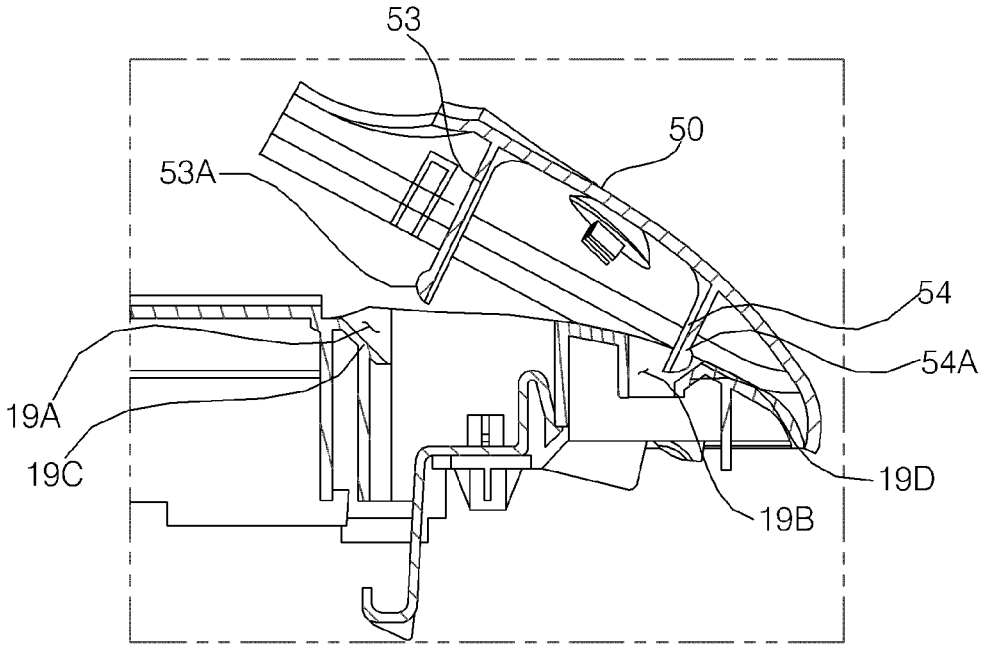
FIG. 18 is a cross-sectional view illustrating a subsequent stage of the operation of removing the second inspection opening cover from the base panel.

FIG. 14 is a view illustrating the intake grille illustrated in FIG. 2, which is open. FIG. 15 is a perspective view illustrating an initial stage of an operation of removing the second inspection opening cover from the base panel. FIG. 16 is a cross-sectional view illustrating the second inspection opening cover, which is coupled to the base panel. FIG. 17 is a cross-sectional view illustrating the initial stage of the operation of removing the second inspection opening cover from the base panel. FIG. 18 is a cross-sectional view illustrating a subsequent stage of the operation of removing the second inspection opening cover from the base panel.

Referring to FIGS. 14 to 18, the first inspection opening cover 40 and the second inspection opening cover 50 are provided with respective dismantling handles 42 and 52. Since the second inspection opening cover 50 is configured to be substantially identical to the first inspection opening cover 40 with the exception that it is further provided with the window hole 51, only the second inspection opening cover 50 will be set forth as an example in the following description.

The second inspection opening cover 50 is provided with the dismantling handle 52, which is positioned at the left side of the inspection opening cover 50, which is opposite the right marginal edge of the inspection opening cover and which protrudes leftward. When there is a need to remove the second inspection opening cover 50 from the base panel 10 for inspection of the air conditioner, the dismantling handle 52 is pulled by a worker. As a result, the left side of the second inspection opening cover 50, at which the dismantling handle 52 is formed, is rotated rightward about the right marginal edge, and thus the second inspection opening cover 50 is removed from the base panel 10.

When the intake grille 30 is mounted on the second edge part 12, the dismantling handle 52 is disposed between the second edge part 12 and the intake grille 30, and thus becomes invisible from the outside. Accordingly, the appearance of the air conditioner is improved compared to the case in which the dismantling handle 52 is provided at the right marginal edge of the second inspection opening cover 50.

When there is a need to remove the second inspection opening cover 50 from the base panel 10, the intake grille is first removed from the base panel 10, and the dismantling handle 52 is pulled so as to allow the inspection opening cover 50 to be removed.

The inspection opening cover 50 is provided on the upper surface thereof with hook protrusions 53 and 54, which are fitted into the hook holes 19A and 19B. The hook protrusions 53 and 54 include a first hook protrusion 53, which is close to the dismantling handle 52, and a second hook protrusion 54, which is spaced apart from the first hook protrusion 53 toward the right marginal edge of the second inspection opening cover 50. The second hook protrusion 54 is spaced apart from the first hook protrusion 53 in the direction opposite the direction in which the dismantling handle 52 protrudes. The first hook protrusion 53 and the second hook protrusion 54 are spaced apart from each other in the lateral direction. The first hook protrusion 53 includes a plurality of hook protrusions, which are spaced apart from each other in the longitudinal direction of the second inspection opening cover 50, and the second hook protrusion 54 also includes a plurality of hook protrusions, which are spaced apart from each other in the longitudinal direction of the second inspection opening cover 50. The hook holes 19A and 19B include a first hook hole 53, into which the first hook protrusion 53 is fitted, and a second hook hole 19B, into which the second hook protrusion 54 is fitted. The first hook hole 19A is formed so as to correspond to the position and number of the first hook protrusions 53, and the second hook hole 19B is formed so as to correspond to the position and number of the second hook protrusions 54.

In the fourth edge part 14 and the sixth edge part 16, the left surface of the first hook hole 19A, which is one of the side surfaces constituting the first hook hole 19A, is provided with a first inclined surface 19C, and the right surface of the second hook hole 19B, which is one of the side surfaces constituting the second hook hole 19B, is provided with a second inclined surface 19D. The first inclined surface 19C and the second inclined surface 19D are inclined so as to become closer to each other moving upward.

The first hook protrusion 53 is provided at the end thereof with a first snap protrusion 53A, which is formed on the left surface thereof opposite the marginal edge of the second inspection opening cover 50, and the second hook protrusion 54 is provided at the end thereof with a second snap protrusion 54A, which is formed on the right surface thereof that faces the marginal edge of the second inspection opening cover 50. When the first hook protrusion 53 is completely fitted into the first hook hole 19A, the first snap protrusion 53A is engaged with the upper end of the first inclined surface 19C. When the second hook protrusion 54 is completely fitted into the second hook hole 19B, the second snap protrusion 54A is engaged with the upper end of the second inclined surface 19D.

When a user pulls the dismantling handle 52 after removing the intake grille 30 from the base panel 10, the second inspection opening cover 50 is rotated about the second hook protrusion 54, which serves as the rotating axis, and is removed from the base panel 10. In the course of removing the second inspection opening cover 50 from the base panel 10, the first hook protrusion 53 comes into contact with the first inclined surface 19C while the second hook protrusion 54 is engaged with the base panel 10, as illustrated in FIG. 17. In this state, the second snap protrusion 54A, formed at the second hook protrusion 54, is engaged with the upper end of the second inclined surface 19D, thereby making it difficult for the second inspection opening cover 50 to fall on the indoor floor.

As is apparent from the above description, the air conditioner according to the embodiment of the present invention has an improved appearance and design because the vane 20 is configured to uniformly close the air outlet 11A by means of the bridges 18.

Furthermore, by virtue of the first water-blocking rib 14B and the second water-blocking rib 14C, it is possible to prevent condensed water from flowing into the control box 91 and thus to prevent breakage or malfunction of the air conditioner.

In addition, since the dismantling handles 42 and 52, which are respectively provided at the inspection opening covers 40 and 50, are not visible from the outside because they are covered by the intake grille 30, the appearance of the air conditioner is improved. Furthermore, since it is possible to repair or inspect the components or wiring in the body 100 through the inspection openings 15A and 16A after removing the inspection opening cover 40 and 50, repair and inspection work is facilitated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising:

a control box accommodating a control board, the control box having a bottom end surface that defines an opening; and a base panel having an air inlet, an air outlet, and a water blocking rib, wherein the bottom end surface of the control box is mounted to and in contact with the base panel, and the water-blocking rib is protruded upward from an upper surface of the base panel to at least partially surround the bottom end surface of the control box.

2. The air conditioner of claim 1, wherein the base panel further comprises a second water-blocking rib, the second water-blocking rib being disposed inside the control box when the control box is mounted to the base panel such that the second-water blocking rib at least partially surrounds an inner surface of the bottom end surface of the control box.

3. The air conditioner of claim 1, wherein the water-blocking rib has a shape corresponding to a shape of the bottom end surface of the control box.

4. The air conditioner of claim 2, wherein the second water-blocking rib has a shape corresponding to a shape of the bottom end surface of the control box.

5. The air conditioner of claim 1, wherein a surface of the base panel on which the control box is mounted is inclined upward, with increasing distance toward an outer edge of the base panel.

6. The air conditioner of claim 1, wherein the water-blocking rib is configured to define a water discharge opening.

7. The air conditioner of claim 1, wherein the water-blocking rib is configured to define a wire opening to receive a wire for connection to the control board.

8. The air conditioner of claim 1, wherein the control board comprises a receiver to receive a control signal, and a light source to emit light when a specific control signal is received by the receiver.

9. The air conditioner of claim 8, wherein the base panel is formed having a receiver hole configured to receive the receiver, and wherein the air conditioner further comprises a receiver window to cover the receiver hole, and an inspection opening cover attached to the base panel, the inspection opening cover having a window hole formed so that the receiver window is exposed therethrough.

10. The air conditioner of claim 9, wherein the receiver window is disposed between the base panel and the inspection opening cover.

11. An air conditioner comprising:

a control box accommodating a control board, the control box having a bottom end surface that defines an opening; and a base panel comprising:

a first edge part having an air outlet, a second edge part having an air inlet, an isolating plate part disposed between the first edge part and the second edge part so as to separate the air outlet from the air inlet, a third edge part disposed at a first side of the first edge part, a fourth edge part disposed at a second side of the first edge part, the control box being mounted on the fourth edge part with the bottom end surface of the control box in contact with the fourth edge part, a fifth edge part disposed at a first side of the second edge part and the isolating plate part, the fifth edge part having at least one inspection opening, and a sixth edge part disposed at a second side of the second edge part and the isolating plate part, the sixth edge part having at least one inspection opening, wherein the fourth edge part includes a water-blocking rib, the water-blocking rib being protruded upward from an upper surface of the base panel to at least partially surround the bottom end surface of the control box.

12. The air conditioner of claim 11, wherein the fourth edge part further comprises a second water-blocking rib at least partially surrounding an inner surface of the bottom end surface of the control box.

13. The air conditioner of claim 11, wherein the water-blocking rib has a shape corresponding to a shape of the bottom end surface of the control box.

14. The air conditioner of claim 12, wherein the second water-blocking rib has a shape corresponding to a shape of the bottom end surface of the control box.

15. The air conditioner of claim 11, wherein the fourth edge part is inclined upward with increasing distance toward an outer edge of the fourth edge part.

16. The air conditioner of claim 11, wherein the water-blocking rib is configured to define a water discharge opening.

17. The air conditioner of claim 11, wherein the water-blocking rib is configured to define a wire opening to receive a wire for connection to the control board.

18. The air conditioner of claim 11, wherein the control board comprises a receiver to receive a control signal, and a light source to emit light when a specific control signal is received by the receiver.

19. The air conditioner of claim 18, wherein the fourth edge part has a receiver hole configured to receive the receiver, and wherein the air conditioner further comprises an inspection opening cover attached to the fourth edge part and the sixth edge part, the inspection opening cover having a receiver window to cover the receiver hole and a window hole formed so that the receiver window is exposed therethrough.

20. The air conditioner of claim 19, wherein the receiver window is disposed between the fourth edge part and the inspection opening cover.

* * * * *